US010280745B2

(12) United States Patent
Eyuboglu et al.

(10) Patent No.: US 10,280,745 B2
(45) Date of Patent: May 7, 2019

(54) METHOD AND APPARATUS FOR EVALUATING FLUID SAMPLE CONTAMINATION BY USING MULTI SENSORS

(75) Inventors: Sami Abbas Eyuboglu, The Woodlands, TX (US); Mark Proett, Missouri City, TX (US); Rohin Naveena Chandran, Lafayette, LA (US); Anthony Herman Van Zuilekom, Houston, TX (US); Li Gao, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 721 days.

(21) Appl. No.: 13/981,634

(22) PCT Filed: Jan. 24, 2012

(86) PCT No.: PCT/US2012/022330

§ 371 (c)(1),
(2), (4) Date: Jul. 25, 2013

(87) PCT Pub. No.: WO2012/103069

PCT Pub. Date: Aug. 2, 2012

(65) Prior Publication Data

US 2013/0311099 A1 Nov. 21, 2013

Related U.S. Application Data

(60) Provisional application No. 61/437,501, filed on Jan. 28, 2011.

(51) Int. Cl.
*E21B 49/08* (2006.01)

(52) U.S. Cl.
CPC ..... *E21B 49/08* (2013.01); *E21B 49/081* (2013.01); *E21B 49/087* (2013.01); *E21B 49/088* (2013.01)

(58) Field of Classification Search
CPC ..... E21B 49/08; E21B 49/081; E21B 49/085; E21B 49/087; E21B 49/088
See application file for complete search history.

(56) References Cited

U.S. PATENT DOCUMENTS

| | | | | |
|---|---|---|---|---|
| 6,799,117 | B1 | 9/2004 | Proett et al. | |
| 7,711,488 | B2 | 5/2010 | Hsu et al. | |
| 2006/0250130 | A1 | 11/2006 | Akkurt et al. | |
| 2008/0156088 | A1 * | 7/2008 | Hsu | E21B 49/10 73/152.23 |

(Continued)

OTHER PUBLICATIONS

Eyubogu et al., A New Real-time Contamination Method that Combines Multiple Sensor Technologies, May 2011, SPWLA 52nd Annual Logging Symposium, pp. 1-11.*

(Continued)

*Primary Examiner* — Sujoy K Kundu
*Assistant Examiner* — L. Anderson
(74) *Attorney, Agent, or Firm* — Benjamin Fite; Baker Botts L.L.P.

(57) ABSTRACT

A method of evaluating fluid sample contamination is disclosed. A formation tester tool is introduced into a wellbore. The formation tester tool comprises a sensor. Sensor data is acquired from the sensor and a contamination estimation is calculated. A remaining pump-out time required to reach a contamination threshold is then determined.

18 Claims, 11 Drawing Sheets

(56) References Cited

U.S. PATENT DOCUMENTS

| | | | | |
|---|---|---|---|---|
| 2009/0078036 | A1* | 3/2009 | Terabayashi | E21B 47/10 73/152.55 |
| 2009/0282907 | A1 | 11/2009 | Zazovsky et al. | |
| 2010/0175873 | A1* | 7/2010 | Milkovisch | E21B 49/008 166/264 |
| 2010/0294491 | A1* | 11/2010 | Zazovsky | E21B 49/087 166/250.01 |
| 2011/0284219 | A1* | 11/2011 | Pomerantz | E21B 49/10 166/264 |
| 2012/0049844 | A1* | 3/2012 | Leveridge | G01V 3/32 324/303 |

OTHER PUBLICATIONS

International Search Report, International Application No. PCT/US2012/022330, 10 pgs, dated Mar. 25, 2013.

* cited by examiner

900

Results

Calculated Filtrate Value: 0.78 gm/cc

Calculated Clean Fluid Value: 0.67 gm/cc

Current Contamination (%) fit 4.6 and (%) raw 5.7

Additional time to reach % 4.0 contamination? 79.61 min

FIG.9

1000

Versus Volume

☐ Acc. Volume ☐ Acc. Volume Correct..

FIG.10

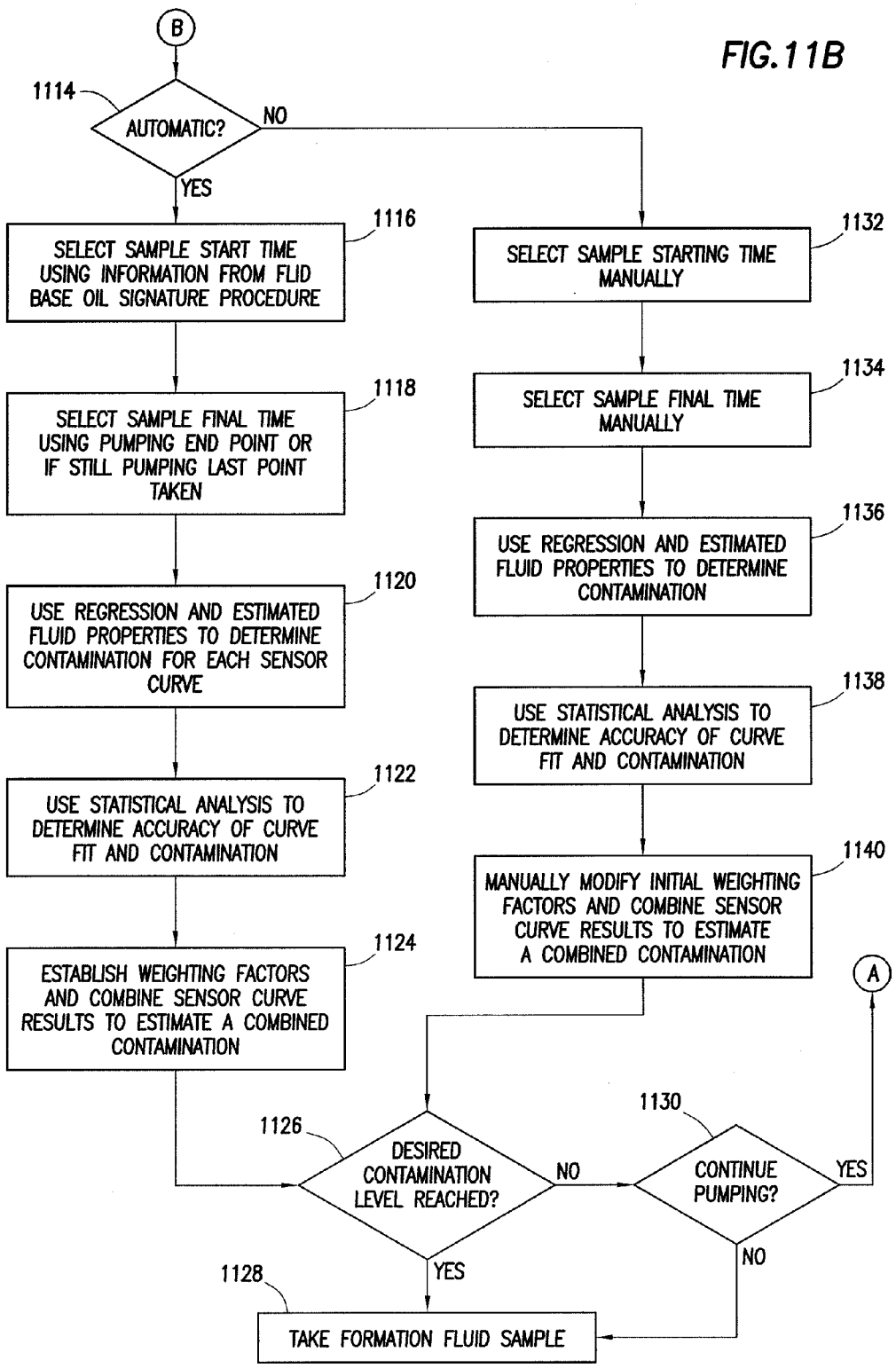
FIG. 11B
B
1114
AUTOMATIC?
NO
YES
1116
SELECT SAMPLE START TIME USING INFORMATION FROM FLID BASE OIL SIGNATURE PROCEDURE
1118
SELECT SAMPLE FINAL TIME USING PUMPING END POINT OR IF STILL PUMPING LAST POINT TAKEN
1120
USE REGRESSION AND ESTIMATED FLUID PROPERTIES TO DETERMINE CONTAMINATION FOR EACH SENSOR CURVE
1122
USE STATISTICAL ANALYSIS TO DETERMINE ACCURACY OF CURVE FIT AND CONTAMINATION
1124
ESTABLISH WEIGHTING FACTORS AND COMBINE SENSOR CURVE RESULTS TO ESTIMATE A COMBINED CONTAMINATION
1132
SELECT SAMPLE STARTING TIME MANUALLY
1134
SELECT SAMPLE FINAL TIME MANUALLY
1136
USE REGRESSION AND ESTIMATED FLUID PROPERTIES TO DETERMINE CONTAMINATION
1138
USE STATISTICAL ANALYSIS TO DETERMINE ACCURACY OF CURVE FIT AND CONTAMINATION
1140
MANUALLY MODIFY INITIAL WEIGHTING FACTORS AND COMBINE SENSOR CURVE RESULTS TO ESTIMATE A COMBINED CONTAMINATION
A
1126
DESIRED CONTAMINATION LEVEL REACHED?
NO
YES
1130
CONTINUE PUMPING?
YES
NO
1128
TAKE FORMATION FLUID SAMPLE

METHOD AND APPARATUS FOR EVALUATING FLUID SAMPLE CONTAMINATION BY USING MULTI SENSORS

CROSS-REFERENCE TO RELATED APPLICATION

This application is a U.S. National Stage Application of International Application No. PCT/US2012/022330 filed Jan. 24, 2012, which claims the benefit of U.S. Provisional Application No. 61/437,501, which was filed Jan. 28, 2011, and are hereby incorporated by reference in their entirety.

BACKGROUND

The present disclosure relates generally to testing and evaluation of subterranean formation fluids, and, more particularly, to methods and apparatuses for evaluating fluid sample contamination by using multiple sensors.

To evaluate prospects of an underground hydrocarbon reserve, a representative sample of the reservoir fluid may be captured for detailed analysis. A sample of the formation fluids may be obtained by lowering a sampling tool having a sampling chamber into the wellbore on a conveyance such as a wireline, slick line, coiled tubing, jointed tubing or the like. When the sampling tool reaches the desired depth, one or more ports are opened to allow collection of the formation fluids. The ports may be actuated in variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

Fluid analysis is possible using pumpout formation testers that provide downhole measurements of certain fluid properties and enable collection of a large number of representative samples stored at downhole conditions. The accurate determination of the fluid properties and contamination while sampling with a wireline pumpout formation tester is the primary objective for obtaining representative fluid samples with minimum rig time. This is an important component of the formation evaluation system established by the oil industry, especially for high-profile and offshore wells. During drilling operations, a wellbore is typically filled with a drilling fluid ("mud"), which may be water-based or oil-based. The mud is used as a lubricant and aids in the removal of cuttings from the wellbore, but one of the most important functions of the mud is well control. Hydrocarbons contained in subterranean formations are contained within these formations at very high pressures. Standard overbalanced drilling techniques require that the hydrostatic pressure in the wellbore exceed the formation pressure, thereby preventing formation fluids from flowing uncontrolled into the wellbore. The hydrostatic pressure at any point in the wellbore depends on the height and density of the fluid column of mud above that point. A certain hydrostatic pressure is desired in order to offset the formation pressure and prevent fluid flow into the well. Thus, it is well known in the art to control the mud density, and it is often necessary to use high density "heavy" mud to achieve a desired hydrostatic pressure.

When the hydrostatic pressure of the mud is greater than the pressure of surrounding formation, drilling fluid filtrate will tend to penetrate the surrounding formation. Thus, the fluid in the formation close to the wellbore will be a mixture of drilling fluid filtrate and formation fluid. The presence of fluid filtrate in the formation can interfere with attempts to sample and analyze the formation fluid. As a fluid sample is drawn from the formation at the wall of the wellbore, the first fluid collected may comprise primarily drilling fluid filtrate, with the amount of filtrate in the mixture typically decreasing as collected volume increases.

Early formation testing tools were designed to draw in a fixed volume of fluid and transport that volume to the surface for analysis. It was soon realized that the fixed volume was not sufficient to collect a reasonable sample of formation fluid because the sample would be primarily drilling fluid filtrate. To solve this problem, formation testing tools were developed which were able to continuously pump fluid into the testing tool so that sample collection could be controlled by the operator. Using these types of tools, the operators attempt to avoid collecting filtrate in the fluid sample by pumping for a period of time before collecting fluid sample. Therefore, it is important to determine the quality of the fluid sample in-situ, with the formation tester still in the well, in order to increase the efficiency and effectiveness of sample collection.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

FIG. 9 depicts a view of example results after a contamination analysis, in accordance with certain embodiments of the present disclosure.

FIG. 10 depicts a view of a volume section instead of time, in accordance with certain embodiments of the present disclosure.

FIGS. 11A and 11B depict a flow diagram for an example estimation of fluid sample and remaining pump-out time, in accordance with certain embodiments of the present disclosure.

Figure 1:
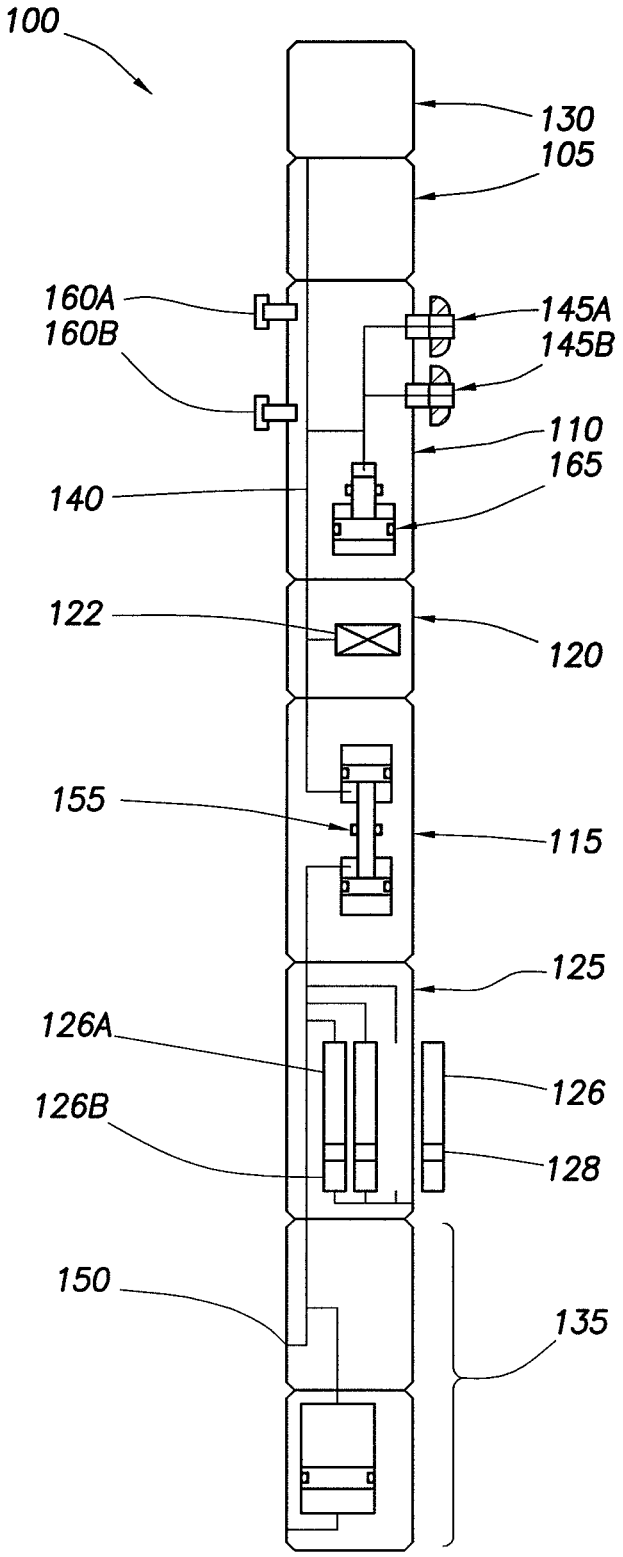
FIG. 1 is a cross-sectional schematic of a testing tool in accordance with an exemplary embodiment of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to testing and evaluation of subterranean formation fluids, and, more particularly, to methods and apparatuses for evaluating fluid sample contamination by using multiple sensors.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For purposes of this disclosure, computer-readable media may include any instrumentality or aggregation of instrumentalities that may retain data and/or instructions for a period of time. Computer-readable media may include, for example without limitation, storage media such as a direct access storage device (e.g., a hard disk drive or floppy disk), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

In the subterranean well drilling and completion art certain tests may be performed on formations penetrated by a wellbore. Such tests may be performed in order to determine geological or other physical properties of the formation and fluids contained therein. For example, parameters such as permeability, porosity, fluid resistivity, temperature, pressure and saturation pressure may be determined. These and other characteristics of the formation and fluid contained therein may be determined by performing tests on the formation before the well is completed.

To facilitate a better understanding of the present disclosure, the following examples of certain embodiments are given. In no way should the following examples be read to limit, or define, the scope of the disclosure. Certain embodiments of the present disclosure may be applicable to horizontal, vertical, deviated, or otherwise nonlinear wellbores in any type of subterranean formation. Certain embodiments may be applicable to injection wells as well as production wells, including hydrocarbon wells. Certain embodiments may be implemented with a tool suitable for testing, retrieval and sampling along sections of the formation. Certain embodiments may be implemented with various samplers that, for example, may be conveyed through a flow passage in a tubular string or using a wireline, slickline, coiled tubing, downhole robot or the like. Certain embodiments may be employed with a wireline pump-out formation tester. Certain embodiments may be suited for use with a modular downhole formation testing tool, such as the Reservoir Description Tool (RDT) by Halliburton, for example. Devices and methods in accordance with certain embodiments may be used in one or more of wireline, measurement-while-drilling (MWD) and logging-while-drilling (LWD) operations. "Measurement-while-drilling" is the term for measuring conditions downhole concerning the movement and location of the drilling assembly while the drilling continues. "Logging-while-drilling" is the term for similar techniques that concentrate more on formation parameter measurement.

Certain embodiments according to the present disclosure may enable not only an understanding of the cleaning behavior of formation fluids, but also the quantitative determination of fluid qualities in real time. Certain embodiments may highlight variables that play an important role in steering the cleanup process, while simultaneously providing trending characteristics of the contamination level versus both time and fluid volume. Certain embodiments may incorporate new fluid sensors to measure various properties of the fluid, including fluid density, resistivity, dielectric, viscosity and optical sensor data. In addition, each physical property sensor may be sensitive to different fluid types, such as resistivity and dielectric for water-based mud ("WBM") contamination, and density and T1 log mean for oil-based mud ("OBM") contamination. Accordingly, suitable physical sensors may be automatically selected to estimate fluid contamination. Multiple sensors may allow for a better understanding of fluid flow and fluid type.

Certain embodiments may be especially pertinent to improve RDT fluid sample contamination reliability and sample quality in general, and to determine the remaining pump-out time required to achieve a target contamination level. Certain embodiments are especially pertinent to optimize rig time utilization by curtailing an RDT pump-out operation as soon as the fluid contamination meets the cleanup target, thereby increasing operational efficiency and increasing sample quality. These and other technical advantages will be apparent to those of ordinary skill in the art in view of this disclosure. While numerous changes may be made by those skilled in the art, such changes are within the spirit of the disclosure.

The accurate determination of the fluid properties and contamination while sampling with a wireline pump-out formation tester, for example, is important in obtaining representative reservoir fluid samples with minimum rig time. Despite advancement in fluid identification sensors, sampling in mixed phases, especially immiscible fluids, still represents a great challenge. Although apparent erratic sensor responses are often attributed to sensor noise, careful study reveals the sensors are actually showing the true nature of the multi-phase fluid flow. However, it is difficult to determine fluid type and contamination if the multi-phase behavior of the fluid flow is not considered.

Acquiring high quality fluid samples in a WBM system, and determining the contamination level is straightforward in many cases. The same is not necessarily true for OBM systems where the fluid properties and/or phase behavior of the hydrocarbon can be altered because the two fluids are miscible. Experimental results indicate that samples contaminated with OBM filtrate can have decreased bubble point pressures, and increased fluid fractions. Although corrections can be applied to compensate for contamination, the conventional contamination limits for accurate analysis are 5% for black oils, and 2% for condensates. Gas condensate systems are more sensitive than black oils, and in some cases, may be converted to oil equivalent systems. The fluid samples taken may have very low contamination levels in order to yield PVT properties that are representative of the uncontaminated hydrocarbons. A formation tester may contain one or more modules that allow the real-time estimation of contamination levels.

FIG. 1 illustrates a cross-sectional schematic of a testing tool 100 which may be employed with certain embodiments of the present disclosure. The formation-testing tool 100 may be suitable for testing, retrieval and sampling along sections of a formation. The testing tool 100 may include several modules (sections) capable of performing various functions. For example, as shown in FIG. 1, the testing tool 100 may include a hydraulic power module 105 that converts electrical into hydraulic power; a probe module 110 to take samples of the formation fluids; a flow control module 115 for regulating the flow of various fluids in and out of the tool 100; a fluid test module 120 for performing different tests on a fluid sample; a multi-chamber sample collection module 125 that may contain various size chambers for storage of the collected fluid samples; a telemetry module 130 that provides electrical and data communication between the modules and an uphole control unit (not shown), and possibly other sections designated in FIG. 1 collectively as 135. The arrangement of the various modules, and additional modules, may depend on the specific application and is not considered herein.

More specifically, the telemetry module 130 may condition power for the remaining sections of the testing tool 100. Each section may have its own process-control system and may function independently. The telemetry module 130 may provide a common intra-tool power bus, and the entire tool string (possible extensions beyond testing tool 100 not shown) may share a common communication bus that is compatible with other logging tools. This arrangement may enable the tool to be combined with other logging systems.

The formation-testing tool 100 may be conveyed in a borehole by wireline (not shown), which may contain conductors for carrying power to the various components of the tool and conductors or cables (coaxial or fiber optic cables) for providing two-way data communication between tool 100 and an uphole control unit (not shown). The control unit preferably includes a computer and associated memory for storing programs and data. The control unit may generally control the operation of tool 100 and process data received from it during operations. The control unit may have a variety of associated peripherals, such as a recorder for recording data, a display for displaying desired information, printers and others. The use of the control unit, display and recorder are known in the art of well logging and are, thus, not discussed further. In an exemplary embodiment, telemetry module 130 may provide both electrical and data communication between the modules and the uphole control unit. In particular, telemetry module 130 may provide a high-speed data bus from the control unit to the modules to download sensor readings and upload control instructions initiating or ending various test cycles and adjusting different parameters, such as the rates at which various pumps are operating.

The flow control module 115 of the tool may include a pump 155, which may be a double acting piston pump, for example. The pump 155 may control the formation fluid flow from the formation into flow line 140 via one or more probes 145A and 145B. The number of probes may vary depending on implementation. Fluid entering the probes 145A and 145B may flow through the flow line 140 and may be discharged into the wellbore via outlet 150. A fluid control device, such as a control valve, may be connected to flow line 140 for controlling the fluid flow from the flow line 140 into the borehole. Flow line fluids may be pumped either up or down with all of the flow line fluid directed into or though pump 155.

The fluid testing section 120 of the tool may contain a fluid testing device, which analyzes the fluid flowing through flow line 140. For the purpose of this disclosure, any suitable device or devices may be utilized to analyze the fluid. For example, Halliburton Memory Recorder quartz gauge carrier may be used. In this quartz gauge the pressure resonator, temperature compensation and reference crystal are packaged as a single unit with each adjacent crystal in direct contact. The assembly is contained in an oil bath that is hydraulically coupled with the pressure being measured. The quartz gauge enables measurement of such parameters as the drawdown pressure of fluid being withdrawn and fluid temperature. Moreover, if two fluid testing devices 122 are run in tandem, the pressure difference between them may be used to determine fluid viscosity during pumping or density when flow is stopped.

The sample collection module 125 of the tool may contain one or more chambers 126 of various sizes for storage of the collected fluid sample. A collection chamber 126 may have a piston system 128 that divides chamber 126 into a top chamber 126A and a bottom chamber 126B. A conduit may be coupled to the bottom chamber 126B to provide fluid communication between the bottom chamber 126B and the outside environment such as the wellbore. A fluid flow control device, such as an electrically controlled valve, can be placed in the conduit to selectively open it to allow fluid communication between the bottom chamber 126B and the wellbore. Similarly, chamber section 126 may also contain a fluid flow control device, such as an electrically operated control valve, which is selectively opened and closed to direct the formation fluid from the flow line 140 into the upper chamber 126A.

The probe module 110 may generally allow retrieval and sampling of formation fluids in sections of a formation along the longitudinal axis of the borehole. The probe module 110, and more particularly the sealing pad, may include electrical and mechanical components that facilitate testing, sampling and retrieval of fluids from the formation. As known in the art, the sealing pad is the part of the tool or instrument in contact with the formation or formation specimen. A probe may be provided with at least one elongated sealing pad providing sealing contact with a surface of the borehole at a desired location. Through one or more slits, fluid flow channel or recesses in the sealing pad, fluids from the sealed-off part of the formation surface may be collected within the tester through the fluid path of the probe.

In the illustrated embodiment, one or more setting rams (shown as 160A and 160B) may be located generally opposite probes 145A and 145B of the tool. Rams 160A and 160B may be laterally movable by actuators placed inside the probe module 110 to extend away from the tool. Pretest pump 165 may be used to perform pretests on small volumes of formation fluid. Probes 145A and 145B may have high-resolution temperature compensated strain gauge pressure transducers (not shown) that can be isolated with shut-in valves to monitor the probe pressure independently. Pretest piston pump 165 may have a high-resolution, strain-gauge pressure transducer that can be isolated from the intra-tool flow line 140 and probes 145A and 145B. Finally, the module may include a resistance, optical or other type of cell (not shown) located near probes 145A and 145B to monitor fluid properties immediately after entering either probe.

With reference to the above discussion, the formation-testing tool 100 may be operated, for example, in a wireline application, where tool 100 is conveyed into the borehole by means of wireline to a desired location ("depth"). The hydraulic system of the tool may be deployed to extend one or more rams 160A and 160B and sealing pad(s) including one or more probes 145A and 145B, thereby creating a hydraulic seal between sealing pad and the wellbore wall at the zone of interest. To collect the fluid samples in the condition in which such fluid is present in the formation, the area near the sealing pad(s) may be flushed or pumped. The pumping rate of the piston pump 155 may be regulated such that the pressure in flow line 140 near the sealing pad(s) is maintained above a particular pressure of the fluid sample. Thus, while piston pump 155 is running, the fluid-testing device 122 may measure fluid properties. Device 122 may provide information about the contents of the fluid and the presence of any gas bubbles in the fluid to the surface control unit. By monitoring the gas bubbles in the fluid, the flow in the flow line 140 may be constantly adjusted so as to maintain a single-phase fluid in the flow line 140. These fluid properties and other parameters, such as the pressure and temperature, may be used to monitor the fluid flow while the formation fluid is being pumped for sample collection. When it is determined that the formation fluid flowing through the flow line 140 is representative of the in situ conditions, the fluid may then be collected in the fluid chamber(s) 126.

When tool 100 is conveyed into the borehole, the borehole fluid may enter the lower section of fluid chamber 126B. This may cause piston 128 to move inward, filling bottom chamber 126B with the borehole fluid. This may be due to the hydrostatic pressure in the conduit connecting bottom chamber 126B and a borehole is greater than the pressure in the flow line 140. Alternatively, the conduit may be closed by an electrically controlled valve, and bottom chamber 126B may be allowed to be filled with the borehole fluid after tool 100 has been positioned in the borehole. To collect the formation fluid in chamber 126, the valve connecting bottom chamber 126B and flow line 140 may be opened and piston pump 155 may be operated to pump the formation fluid into flow line 140 through the inlets of the sealing pad(s). As piston pump 155 continues to operate, the flow line pressure may continue to rise. When the flow line pressure exceeds the hydrostatic pressure (pressure in bottom chamber 126B), the formation fluid may start to fill in top chamber 126A. When the upper chamber 126A has been filled to a desired level, the valves connecting the chamber with both flow line 140 and the borehole may be closed, which may ensure that the pressure in chamber 126 remains at the pressure at which the fluid was collected therein.

One approach to real-time estimation of contamination levels is based on the optical properties of the fluids entering the tester. The technique basically utilizes the differences in the absorption spectrum (color contrast) between the OBM contaminant and the formation fluid to deconvolute the spectrum from a fluid measurement. Optical sensors measure the optical density of the flowing fluid and uses empirical relationships to transform the optical density into data on contamination by determining the composition of the measured absorbed light spectrum from the sample. Depending on this absorption spectrum, one can estimate the types of materials present in the fluid and proportion of each material in the fluid. One problem with optical analysis is that the measured property is assumed as directly linked to contamination and may not necessarily be the case.

Another approach to contamination estimation is to use electrical resistivity that is based on the measurement of the apparent resistivity of fluids entering the tool. The MRILab Fluid Analyzer, available via Halliburton, in combination with the RDT, may offer an alternative based on the Nuclear Magnetic Resonance (NMR) properties of the fluids. The other fluid property is fluid density to evaluate the quality of a fluid sample downhole is monitoring of a fluid property over time.

A high resolution fluid density sensor may quickly and reliably monitor the change of frequency of a vibrating tube immersed in the fluid sample. A vibrating-tube density sensor may operate under the physical premise that its resonance frequency is directly related to the density of fluid within the tube. In reality, however, because of its high sensitivity, the sensor response is influenced by multiple factors, including sensor temperature, pressure, and specific mechanical design configuration.

By using a density sensor, fluid density is measured at downhole and measured density is plotted as a function of time. As time increases, the measured fluid density in the sample volume changes until it levels out very close to the density of the formation fluid. This leveling out of the density is known as asymptotic convergence and the value of density at this point is the asymptotic value. It is usually preferred to acquire a sample of the formation fluid when the measured properties of the sample fluid reach asymptotic levels, which indicates that the amount of filtration in the sample cannot be reduced further. The difficulty with this method is that, although equilibrium between the amounts of formation fluid and drilling fluid filtrate entering the sample volume has been reached, the level of contamination of the fluid mixture may still not be known. Therefore, to use multi sensors (T1 log mean, viscosity index, etc.) during the contamination estimation will allow a better understanding of fluid flow and fluid type. The easy visual interpretation of T1 domain when changes observed in the T1 distributions as a function of pump-out time makes an advantage of contamination estimation. The change in fluids can be visually detectable, going from mud filtrate to oil, over a span of experiments. The relation used to transform T1 log mean to viscosity η in the contamination estimation algorithm is given by $$\eta = 0.0095_{58} * \frac{T}{T1\text{logmean}}$$

where T is absolute temperature in degrees Kelvin, T1 log mean in seconds, and η in centipoises. The transformation is the so-called dead oil formula, and generally fails to define the behavior in live oils. In the case of live oils, the viscosity relationship is of the form:

$$\eta = 0.0095_{58} * \frac{T}{f(GOR) * T1\text{logmean}}$$

The GOR (gas/oil ratio) function may be known before the T1 log mean can be correlated to viscosity. Such information is rarely available in a real-life situation. The properties of the hydrocarbon, including its viscosity and GOR, are unknown at the time of the MRILab measurements. Given that f(GOR) is not always known, the end-point viscosities computed in the contamination algorithm may not always be correct. However, lack of GOR information does not adversely impact the contamination estimates. Whether the hydrocarbon is dead or live, its T1 log mean is still inversely proportional to its viscosity. The actual proportionality constant needed for viscosity may be different, but the volumetric information derived from the data is still correct. Since the T1 log mean to viscosity transformation is not exact, it is therefore better to refer viscosity indices rather than absolute viscosities.

In certain embodiments, contamination may be estimated as a function of time. An important feature of any contamination algorithm is the ability to estimate the Contamination Index (CI) at a given time, and predict the additional time needed to reach a certain threshold.

This requirement brings the time dimension into the problem. In certain exemplary embodiments, a contamination algorithm may have two parts: (1) a time function that describes the behavior of fluid property (density, viscosity index or T1 log mean) versus time; and (2) a mixing model that can estimate the volume fractions of two fluids given any fluid properties information. In certain exemplary embodiments, the following functions may model the measured fluid properties as a function of time.

| | |
|---|---|
| $f(t) = c_3 + c_1 * \text{atan} * \left(\frac{t^p}{c_z}\right)$ | Model 1 |
| $f(t) = c_3 - c_1 * \exp\left(\frac{-t^p}{c_z}\right)$ | Model 2 |
| $f(t) = c_3 + c_1 * \text{atan}\left(\frac{t-p}{c_z}\right)$ | Model 3 |
| $f(t) = c_3 + c_1 * \text{atan}(t^p + c_z)$ | Model 4 |
| $f(t) = c_3 - c_1 * \exp\left(-\frac{t}{c_z}\right)$ | Model 5 |

where the unknown parameter vector $\rho=[c_1\ c_2\ c_3\ p]^T$. These unknowns may be adjusted such that f(t) match the measured data. Thus, to determine these unknown vectors, a nonlinear least square problem is posed and solved (by an optimizer) such that the following function is minimized:

$$\min_{\rho} \Sigma_{i=1}^{N} (f(i) - \text{real data})^2$$

where i denotes an experiment and N denotes the total number of experiments in the dataset. After the optimizer has determined the unknown parameters, the data value of contaminant $v_1$ and of the formation fluid $v_2$ is determined by extrapolating f(t) to t=0 and t=∞ respectively. Thus, $v_2$=f(t=0), an $v_2$=f(t=∞).

Figure 2:
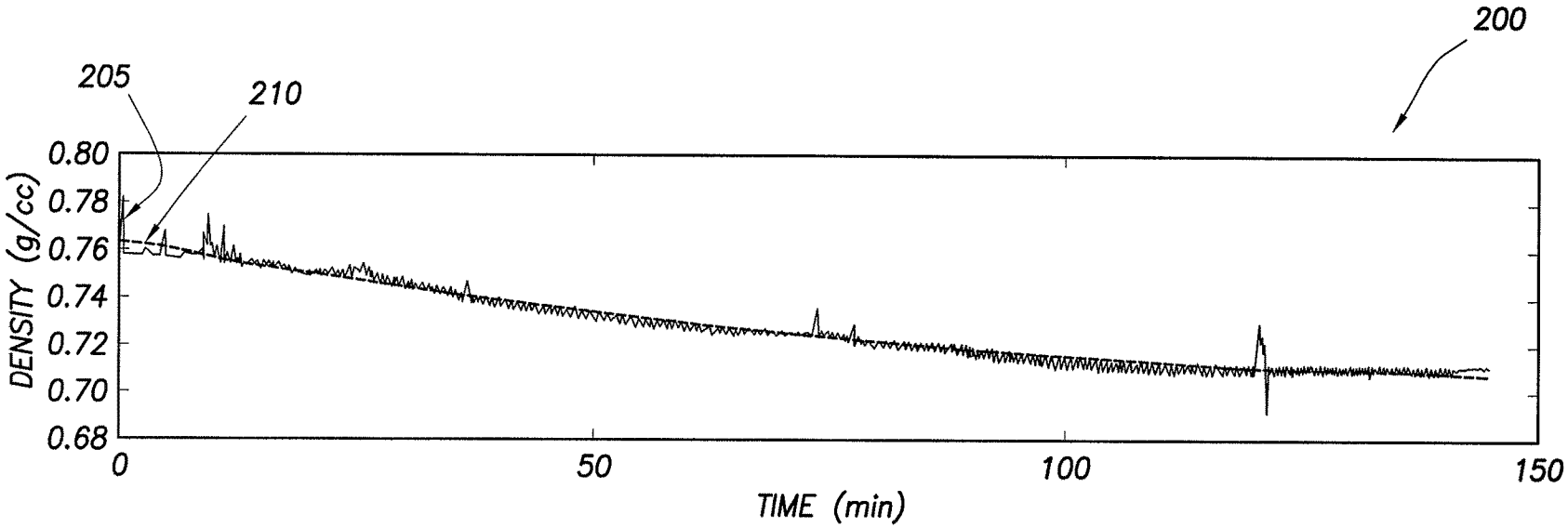
FIG. 2 depicts an example representation of a plot of real density data and computer model fit data modeling the measured fluid property as a function of time, in accordance with certain embodiments of the present disclosure.

FIG. 2 depicts an example representation 200 of a plot of real-time density data and computer model fit data modeling the measured fluid property as a function of time, in accordance with certain embodiments of the present disclosure. Real-time density data is demonstrated by line 205. Computer model fit data is demonstrated by dashed line 210.

In certain exemplary embodiments, when the $v_1$ and $v_2$ have been determined from the data fit, they may be used to compute the volumetric saturation of the contaminant at each experiment. For this purpose, consider five mixing models. All of them relate the data values of fluid mixture f(t) to the end point data values $v_1$ and $v_2$, given their respective saturations $s_1$=CI and $s_2$=1−CI:

| | |
|---|---|
| $f = \frac{v_1 * v_2}{\left[s_1 * v_2^{\frac{1}{n}} + s_2 * v_1^{\frac{1}{n}}\right]^n}$ | |
| $f = [s_1 * v_1^n + s_2 * v_2^n]^{\frac{1}{n}}$ | Power-Law |
| $\ln(f) = s_1 * \ln(v_1) + s_2 * \ln(v_2)$ | Arrhenius |
| $\ln(f) = \frac{\propto s_1}{\propto s_1 + s_2} * \ln(v_1) + \left[1 - \frac{\propto s_1}{\propto s_1 + s_2}\right] * \ln(v_2)$ | Modified Arrhenius |
| $f = s_1 * (v_1 - v_2) + v_2$ | Linear |

where n is tuning parameter that depends on the fluid mixture and on the proportions of the individual components, and ∝ is an empirical constant usually having values between 0 and 1. To estimate the contamination index at each experiment, we simply solve for CI in each of the equations above.

Accordingly, certain embodiments may include one or more of the steps of: reading real-time data; in a least square fashion, fit f(t) to a parameterized function of a given structure (real-time data); computing the least square fit of the contaminant: $v_1$=f(t=0), and of the formation fluid: $v_2$=f(t=∞); and computing the contamination index by applying a fluid mixing model by using $v_1$, $v_2$ and f.

Certain embodiments according to the present disclosure may include a real-time contamination program incorporating contamination algorithms and fluid sensor data such as the fluid density, resistivity, dielectric, viscosity, and optical sensor data. Numerical and analytical models may be capable of measuring and describing the cleaning behavior of formation fluids and their qualities, thus accessing a reliable downhole fluid contamination content by drilling fluid filtrate using logging tools sensors. Each physical property sensor may be sensitive to different fluid types, such as resistivity and dielectric for WBM contamination, and density and T1 log mean for OBM contamination. The contamination program may automatically select suitable physical sensors to estimate the fluid contamination. Multiple sensors will allow a better understanding of fluid flow and fluid type. Certain embodiments may be implemented with the INSITE® data acquisition program available via Halliburton.

Figure 3:
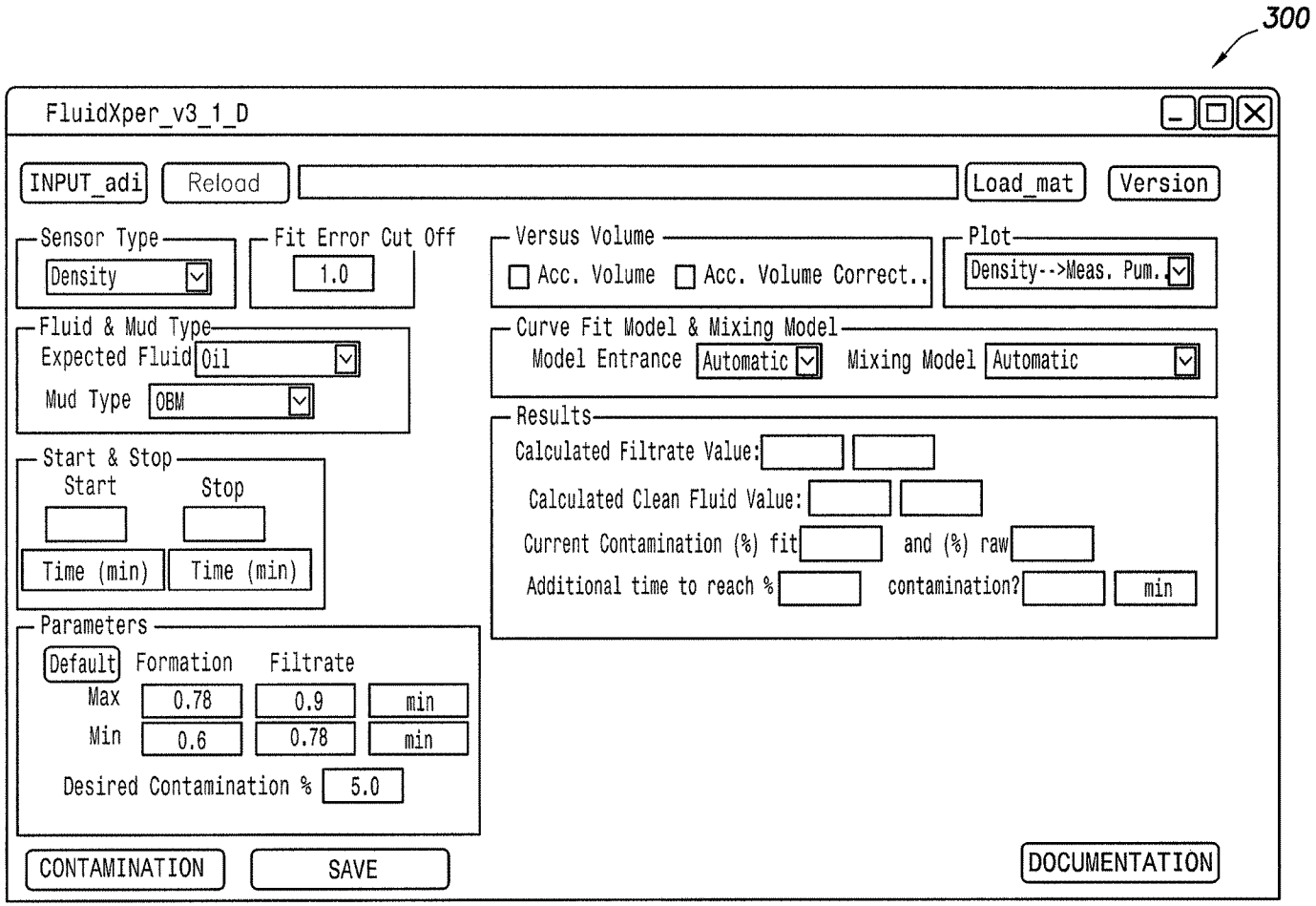
FIG. 3 depicts an example display of an example contamination computer program, in accordance with certain embodiments of the present disclosure.
Figure 4:
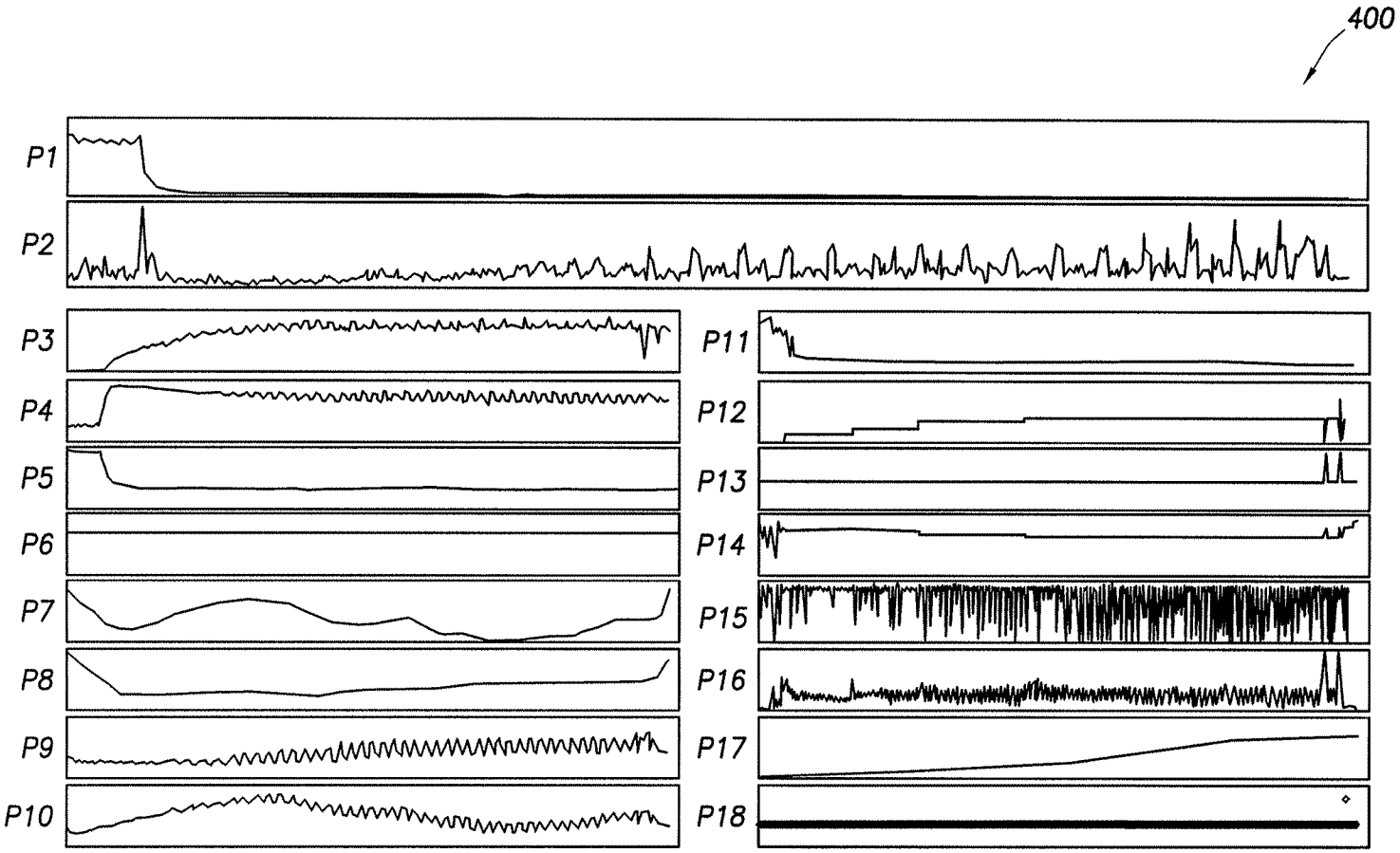
FIG. 4 depicts example plots created once data is loaded to the contamination computer program, in accordance with certain embodiments of the present disclosure.

FIG. 3 depicts an example display 300 of an example contamination evaluation computer program, in accordance with certain embodiments of the present disclosure. To load the data to the exemplary contamination evaluation program depicted in FIG. 3, the Input_adi button may used to reach a database structure with the corresponding data. FIG. 4 depicts an example display 400 of exemplary plots created once data is loaded to the contamination computer program, in accordance with certain embodiments of the present disclosure. Accordingly, in certain exemplary embodiments, after data may be selected and transferred, eighteen plots may be depicted on a computer display as illustrated by the nonlimiting example of FIG. 4. It should be appreciated that FIG. 4 is merely an example, and any suitable number and variation of the plots may be employed. The plots may serve as a quality check of the job before starting the contamination analysis. The plots may help a user identify the nature of the data readings obtained during the job and may help the user decide which data would be most useful in performing a particular contamination analysis. Exemplary names of the data in each plot are shown in Table 1.

TABLE 1

| | |
|---|---|
| P1 | Viscosity indices |
| P2 | Average T1 Fit Error |
| P3 | T1 log mean (ms) |
| P4 | Hydrogen Index |
| P5 | Capacitance (pF) |
| P6 | Estimated Resistivity and Baseline Resistivity |
| P7 | Fluid Temperature Difference (F.) |
| P8 | Fluid Temperature (F.) |
| P9 | Fluid Flow Temperature (F.) |
| P10 | Flow Temperature Difference (F.) |
| P11 | Density and Average Density (g/cc) |
| P12 | Measured Pump Rate and DPS Rate |
| P13 | Outlet Pressure (psi) |
| P14 | Inlet Pressure (psi) |
| P15 | Flow Pressure (psi) |
| P16 | Purge Pressure (psi) |
| P17 | Accumulated Volume and Accumulated Corrected Volume (lt) |
| P18 | Spherical Mobility |

Figure 5:
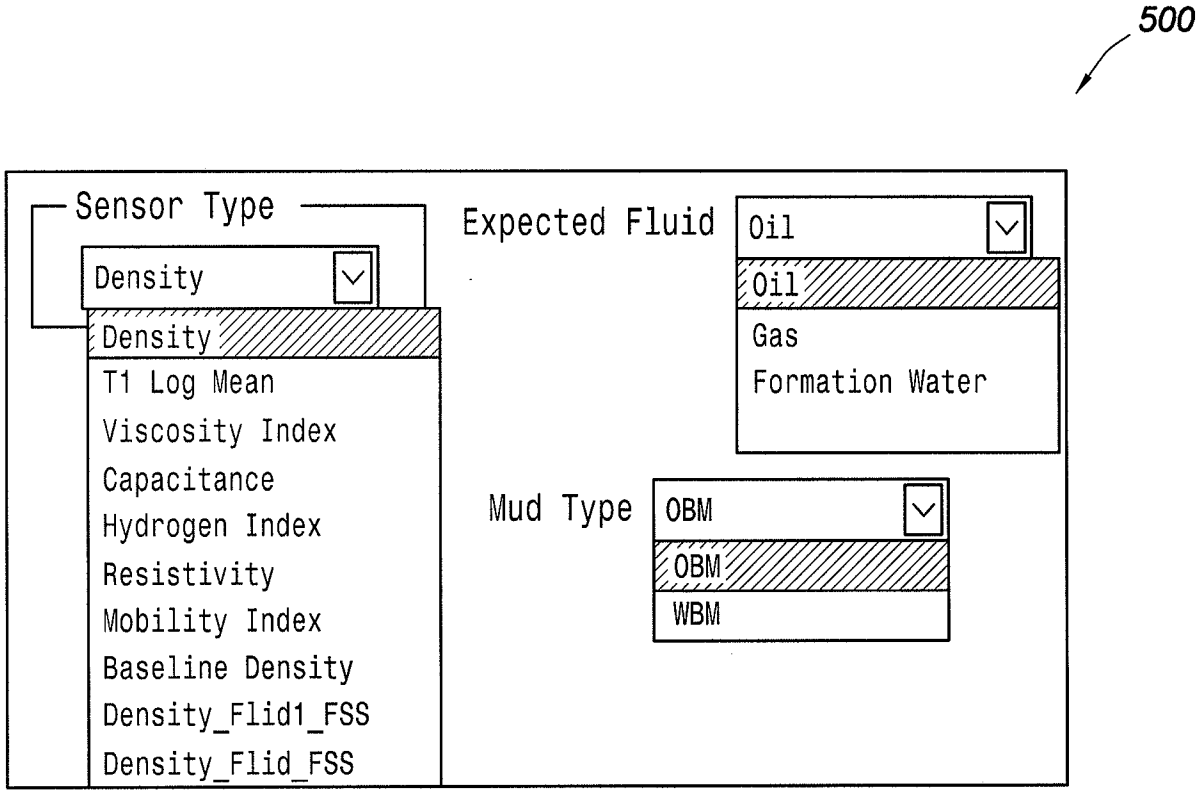
FIG. 5 depicts an example representation of exemplary Sensor Type, Expected Fluid and Mud Type options, in accordance with certain embodiments of the present disclosure.

FIG. 5 depicts an example representation 500 of exemplary Sensor Type, Expected Fluid and Mud Type options, in accordance with certain embodiments of the present disclosure. Sensor Type options may provide the user different data (for example, Density, T1 Log mean, Viscosity Index, Capacitance, Hydrogen Index, Resistivity, Mobility Index, Baseline Density, Density_Flid1_FSS, Density_Flid_FSS) that may be utilized to estimate the contamination level of the fluid in the formation. In certain exemplary embodiments, expected fluid (oil, gas and formation water) and mud type (OBM or WBM) may also be selected before starting the contamination estimation.

In certain exemplary embodiments, start and stop time may be selected as the beginning and end points of the contamination analysis. If these times are kept blank, the start time is zero and the stop time is the last time data is recorded. Start time is the time of the filtrate density as shown in the sensor. If the density of the filtrate is known, the start time may be implemented in the program, and, therefore, more accurate contamination estimation can be calculated.

Figure 6A:
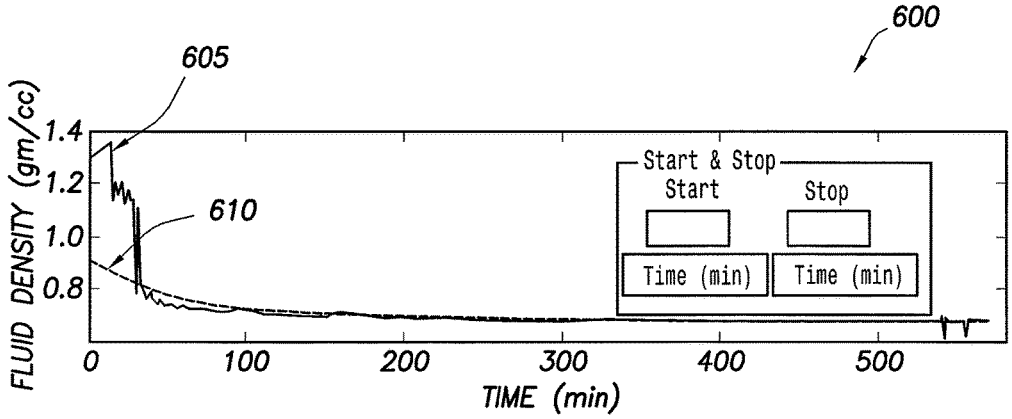
FIGS. 6A, 6B and 6C depict an example representation of exemplary contamination estimation analysis results when start and stop are kept blank, in accordance with certain embodiments of the present disclosure.
Figure 6B:
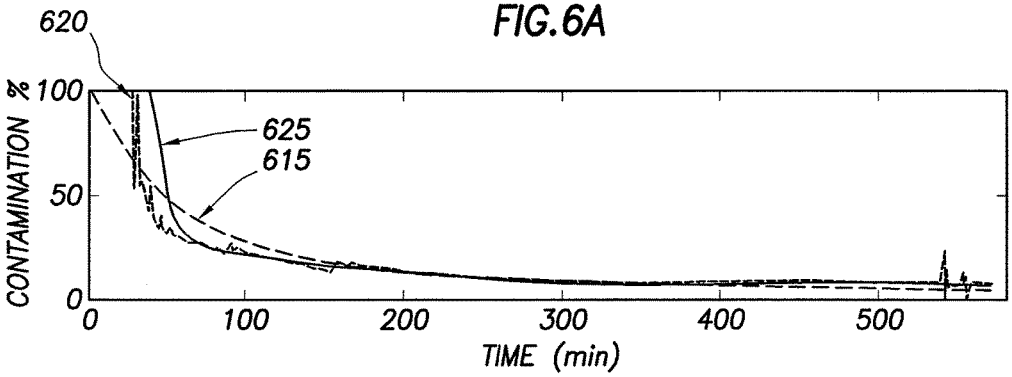
Figure 6C:
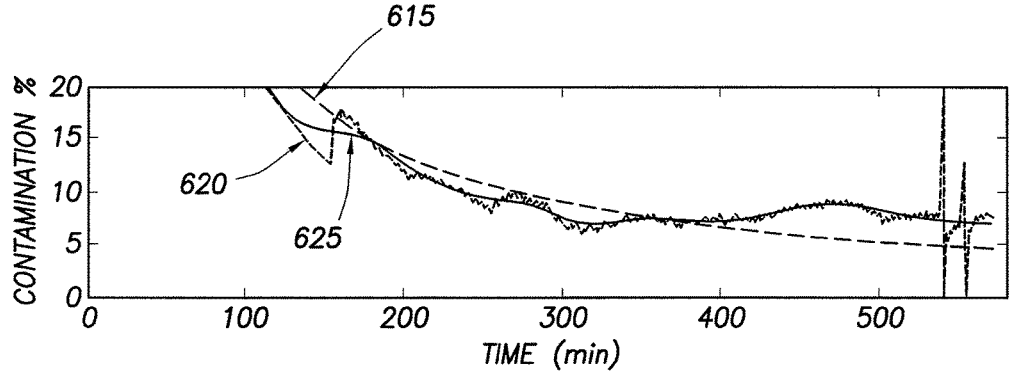

FIGS. 6A, 6B, and 6C depict an example representation 600 of exemplary contamination estimation analysis results when start and stop are kept blank, in accordance with certain embodiments of the present disclosure. In FIG. 6A, the top panel (A) shows the data that may be used to estimate the contamination versus time. In this exemplary embodiment, density data may be employed for the test. The line 605 may be the real time (density) and dotted line 610 may be the computer-fit data. In FIG. 6B, the middle panel (B) may be the contamination results versus time. The line 615 may be the contamination estimation for computer-fit data. The line 620 may be the contamination estimation for real data. The line 625 may be the "moving filter" developed for the green curve. In FIG. 6C, the bottom panel (C) is an enlarged view of middle panel between 0 to % 20. However, if the filtrate is known, start and stop times may be entered to calculate a more accurate contamination estimation.

In certain embodiments, a pre-job method may be used to estimate the base oil density before the job. In a certain exemplary embodiment, a pre-job method may be used when sampling in oil/synthetic-based mud types. These methods, discussed in further detail below, may be employed with assembly 700 of FIG. 7, for example.

Figure 7:
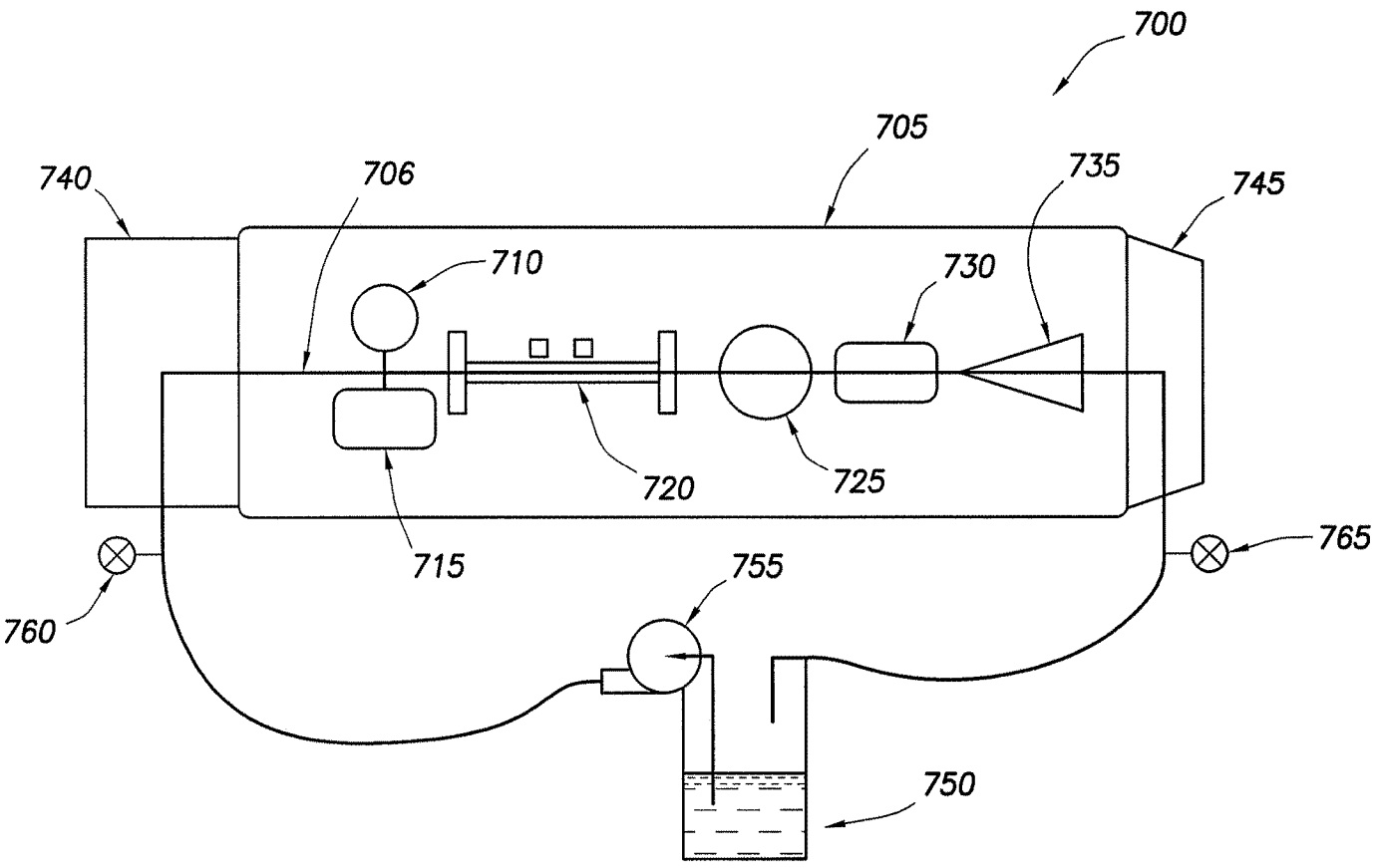
FIG. 7 depicts an example assembly to check Fluid Identification (FLID) Base Oil Signature, in accordance with certain embodiments of the present disclosure.

FIG. 7 depicts an example assembly 700 to check a fluid identification (FLID) base oil signature, in accordance with certain embodiments of the present disclosure. The assembly 700 may include a FLID tool 705, which may include one or more of a pressure sensor 710, a temperature sensor 715, a density sensor 720, a resistivity sensor 725, a temperature sensor 730, and a capacitance sensor 735 coupled to a flowline 706. The assembly 700 may be employed to check the signature of base oil through the FLID tool 705 to determine readings of the density, resistivity and capacitance sensors at surface temperature and a specified pressure. This check may be performed at the well site with a base oil sample used during a recent circulation. The assembly 700 may be connected using an electronics and flowline crossover 740 at the top and a terminator section 745, such as a standard RDT bull plug terminator, at the bottom, for example. Base oil may be stored in any suitable container 750 and pumped into the tool 705, for example, with a high pressure air driven pump 755. Initially, air may be circulated through the tool 705 to obtain an air signature. Next, the base oil may flow through the tool 705 to a specific pressure. Once the flowing signature is obtained, the chokes 760 and 765 at the inlet and outlet, respectively, of the tool may be closed to obtain a static reading under pressure. Both the flowing and static readings may then be used as an input for real-time contamination analysis downhole.

In a certain exemplary embodiment, a pre-job procedure may be as follows: (1) connect the FLID tool 705 with the crossover 740 and bull plug 745, for example, as shown in FIG. 7; (2) power up the FLID tool 705 and begin a station log; (3) with the pump 755 exposed to air, open inlet and outlet chokes 760, 765 and circulate air through the assembly 700; (4) immerse the pump 755 in the base oil container 750 and establish flow of base oil through the tool 705; (5) while monitoring the pressure sensor 710 in the assembly 700, control the outlet choke 765 to achieve a desired pressure; (6) maintain the pressure for sufficient time to record readings under flowing conditions; (7) close the inlet choke 760 and hold pressure to obtain readings under static conditions; (8) open inlet and outlet chokes 760, 765 and remove the pump 755 from the base oil, circulating air through the assembly 700; (9) stop station log and power down the FLID 705; (10) disconnect all connections and prepare the assembly 700 to be run into the wellbore. Any suitable power source may be employed, including battery, generator or other power source, depending on the design needs and implementation.

Figure 8A:
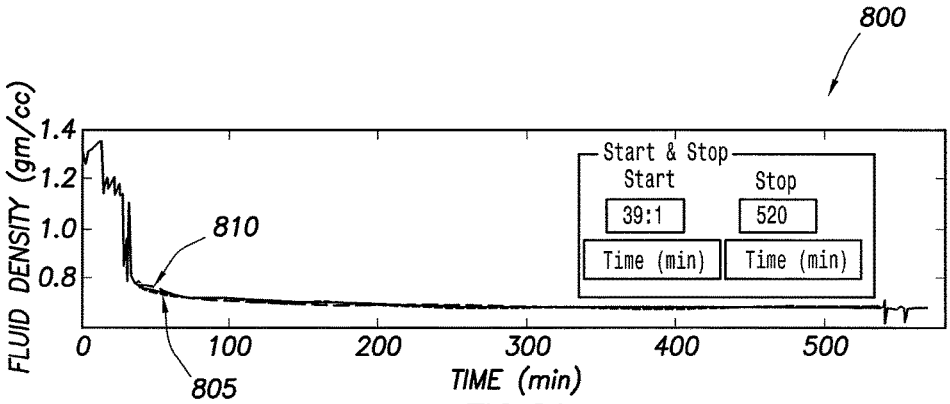
FIGS. 8A, 8B and 8C depict a view of example contamination estimation analysis results when start and stop times are selected, in accordance with certain embodiments of the present disclosure.
Figure 8B:
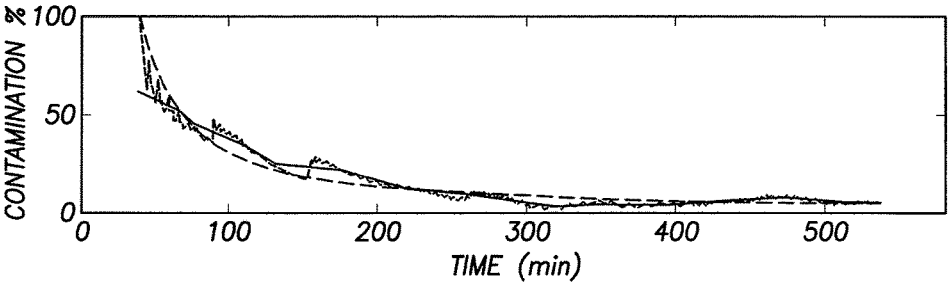
Figure 8C:
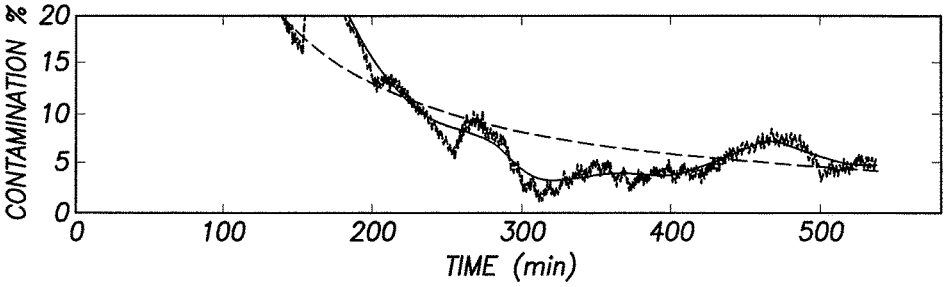

FIGS. 8A, 8B and 8C depict a view of example contamination estimation analysis results 800 when start and stop times are selected, in accordance with certain embodiments of the present disclosure. In the contamination estimation analysis results 800, exemplary start and end times of 39.1 and 520 min are used. One difference between FIGS. 6A, 6B and 6C and FIGS. 8A, 8B and 8C is that, in the top panel of FIG. 8A, the line 805 demonstrates the real data (density) between selected start and stop time, and the contamination line 810 is represented between start and stop time.

FIG. 9 depicts a view of example results 900 after a contamination analysis, in accordance with certain embodiments of the present disclosure. FIG. 9 shows the filtrate and the clean fluid density calculated by the computer using the mathematical models, and these values are used in the contamination estimation. In this example, 0.78 g/cc and 0.67 g/cc are the filtrate and clean fluid values that the contamination computer program calculated respectively. Contamination result estimates for fit data (line 810) is % 4.6 and for real data line 805 is % 5.7. To reach the desired % 4.0 contamination, 79.61 more minutes of pump-out may need to be performed. Knowing the accurate remaining pump-out time may help determine whether to continue to pump or to take the sample.

FIG. 10 depicts a view of a volume section 1000 instead of time, in accordance with certain embodiments of the present disclosure. In certain embodiments, the user may have the option to analyze the contamination estimation as function of, or versus, accumulated volume and accumulated corrected volume, as seen in FIG. 10. However, while certain examples herein consider volume-based estimation values, it should be understood that contamination estimation may be converted from volume-based to weight-based.

Figure 11A:
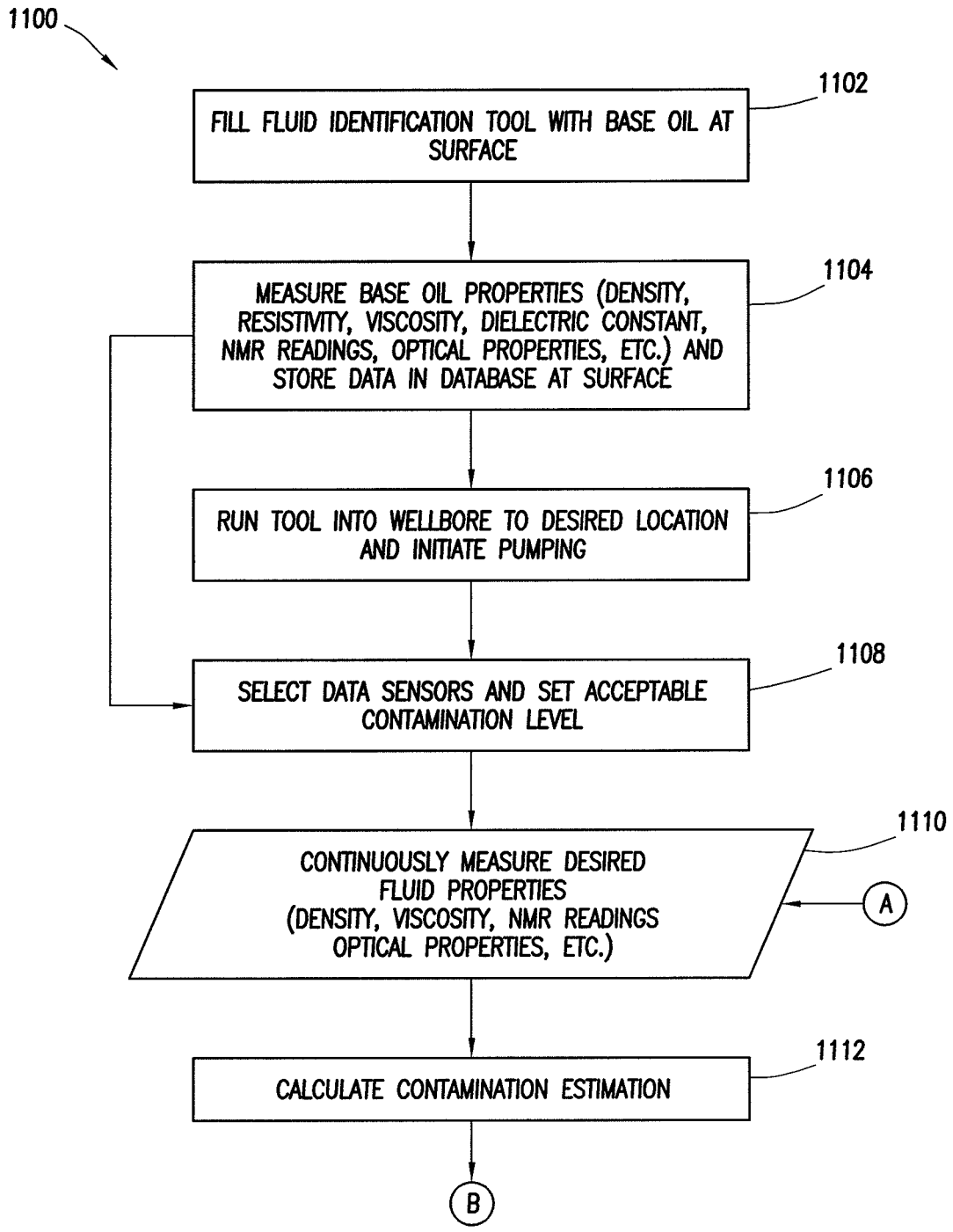

FIGS. 11A and 11B depict a flow diagram for an example method 1100 estimation of fluid sample and remaining pumpout time, in accordance with certain embodiments of the present disclosure. Teachings of the present disclosure may be utilized in a variety of implementations. As such, the order of the steps 1102-1140 comprising the method 1100 may depend on the implementation chosen.

Methods and apparatuses in accordance with certain embodiments of the present disclosure may be effective for estimating the fluid sample contamination and remaining pump out time. In certain embodiments, suitable physical sensors may be automatically selected to estimate the fluid contamination. Multiple sensors may allow a better understanding of fluid flow and fluid type. Moreover, knowledge of the filtrate density before the job will assist to calculate more accurate contamination estimation. Knowledge of the accurate remaining pump-out time will help a user to decide either to continue to pump or to take the sample. Certain embodiments may be implemented in any mud type. Certain embodiments of the present disclosure may utilize a vibrating tube density sensor which enables highly accurate and repeatable downhole measurements of fluid density and provides accurate contamination estimation. Certain embodiments may have improved accuracy by allowing the filtrate density to be known before the job which will help calculate a more accurate contamination estimation.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method of evaluating fluid sample contamination, comprising:

introducing a formation tester tool into a wellbore, wherein the formation tester tool comprises a plurality of sensors;

extending one or more probes of the formation tester tool to create a seal between the one or more probes and the wellbore;

pumping by a pump of the formation tester tool a fluid at the one or more probes, wherein the pumping rate of the pump maintains a flow line pressure in a flow line coupled to the one or more probes above a particular pressure;

automatically selecting at least one of the plurality of sensors to calculate a contamination estimation of the fluid based, at least in part, on one or more fluid properties to be measured and a sensitivity of the at least one of the plurality of sensors to the one or more fluid properties to be measured;

acquiring sensor data from the at least one of the plurality of sensors;

calculating a clean fluid density;

calculating the contamination estimation based, at least in part, on the sensor data and the clean fluid density;

determining a remaining pump-out time required to reach a contamination threshold based, at least in part, on the contamination estimation; and performing further pumping by the pump or taking by the formation tester tool a sample of the wellbore fluid based, at least in part, on the remaining pump-out time.

2. The method of evaluating fluid sample contamination of claim 1, further comprising:

determining whether a contamination threshold has been reached.

3. The method of evaluating fluid sample contamination of claim 2, further comprising:

taking the fluid sample when the contamination threshold has been reached.

4. The method of evaluating fluid sample contamination of claim 1, further comprising:

curtailing a pump-out operation after the contamination threshold has been reached based, at least in part, on the contamination estimation.

5. The method of evaluating fluid sample contamination of claim 1, further comprising:

curtailing a pump-out operation after the contamination threshold has been reached based, at least in part, on the remaining pump-out time.

6. The method of evaluating a fluid sample of claim 1, wherein the contamination estimation is a function of time.

7. The method of evaluating a fluid sample of claim 1, wherein the sensor data is acquired in real time.

8. The method of evaluating fluid sample contamination of claim 1, wherein the sensor data comprises one or more of fluid density data, resistivity data, dielectric data, viscosity data, and optical sensor data.

9. The method of evaluating fluid sample contamination of claim 1, wherein the at least one of the plurality of sensors is sensitive to a plurality of fluid types.

10. The method of evaluating fluid sample contamination of claim 1, further comprising:

taking sensor readings of a base oil, wherein the sensor readings indicate a property of the base oil;

wherein the contamination estimation is based, at least in part, on the property of the base oil.

11. A tangible non-transitory computer-readable medium with an executable program stored thereon for evaluating fluid sample contamination, the executable program comprising executable instructions that cause a processor to:

extend one or more probes of the formation tester tool to create a seal between the one or more probes and the wellbore;

pump by a pump of the formation tester tool a fluid at the one or more probes, wherein the pumping rate of the pump maintains a flow line pressure in a flow line coupled to the one or more probes above a particular pressure;

automatically select at least one of a plurality of sensors to calculate a contamination estimation of the fluid based, at least in part, on one or more fluid properties to be measured and a sensitivity of the at least one of the plurality of sensors to the one or more fluid properties to be measured;

read sensor data acquired via a formation tester tool introduced into a wellbore;

calculate a clean fluid density;

calculate a contamination estimation based, at least in part, on the sensor data and the clean fluid density;

determine a remaining pump-out time required to reach a contamination threshold based, at least in part, on the contamination estimation; and perform further pumping by the pump or taking a fluid sample by the formation tester tool based, at least in part, on the remaining pump-out time.

12. The tangible non-transitory computer-readable medium of claim 11, wherein the contamination estimation is a function of time.

13. The tangible non-transitory computer-readable medium of claim 11, wherein the sensor data is read in real time.

14. The tangible non-transitory computer-readable medium of claim 11, wherein the sensor data comprises one or more of fluid density data, resistivity data, dielectric data, viscosity data, and optical sensor data.

15. The tangible non-transitory computer-readable medium of claim 11, wherein the executable instructions further cause the computer to:

read sensor data corresponding to a base oil, wherein the sensor data corresponding to a base oil indicates a property of the base oil;

wherein a contamination estimation is based, at least in part, on the property of the base oil.

16. The tangible non-transitory computer-readable medium of claim 11, wherein the calculating the contamination estimation comprises computing a contamination index.

17. The tangible non-transitory computer-readable medium of claim 16, wherein the computing the contamination index is based, at least in part, on a mixing model.

18. The tangible non-transitory computer-readable medium of claim 11, wherein a contamination estimation is based, at least in part, on one or more of a regression and a statistical analysis.

* * * * *